US007195556B1

(12) United States Patent
Fichtelman

(10) Patent No.: US 7,195,556 B1
(45) Date of Patent: Mar. 27, 2007

(54) MOVEABLE SOFFIT COVER SYSTEM AND ASSOCIATED METHODS

(76) Inventor: Thomas K. Fichtelman, 1212 Castaway Blvd., Vero Beach, FL (US) 32963

( * ) Notice: Subject to any disclaimer, the term of this patent is extended or adjusted under 35 U.S.C. 154(b) by 0 days.

(21) Appl. No.: 11/263,731

(22) Filed: Nov. 1, 2005

(51) Int. Cl.
*F24F 7/02* (2006.01)

(52) U.S. Cl. ..... 454/260; 52/95

(58) Field of Classification Search ..... 454/239, 454/240, 241, 260; 52/94, 95, 96, 198, 199
See application file for complete search history.

(56) References Cited

U.S. PATENT DOCUMENTS

| | | | | |
|---|---|---|---|---|
| 2,718,187 A | | 9/1955 | Frisby | |
| 2,936,692 A | | 5/1960 | White | |
| 3,027,090 A | | 3/1962 | Zerhan, Jr. | |
| 3,830,146 A | | 8/1974 | Kaiser | 98/41 SV |
| 4,103,825 A | | 8/1978 | Zornig | 237/1 A |
| 4,195,455 A | * | 4/1980 | Chalmers et al. | 52/94 |
| 4,667,581 A | | 5/1987 | Hovland | 98/37 |
| 4,715,268 A | | 12/1987 | Tanner | 98/41.1 |
| 5,243,793 A | * | 9/1993 | MacLeod et al. | 52/95 |
| 5,718,086 A | * | 2/1998 | Dunn | 52/95 |
| 5,956,903 A | | 9/1999 | Parker | 52/1 |
| 5,989,119 A | * | 11/1999 | Raisanen | 454/239 |

* cited by examiner

*Primary Examiner*—Gregory Wilson
(74) *Attorney, Agent, or Firm*—Mark R. Malek; The Torpy Group, P.L.

(57) ABSTRACT

A moveable soffit cover system includes a guide track for connecting to a structure adjacent a soffit panel having a plurality of vents formed therein, and a soffit vent cover slidably connected to the guide track to overlie the soffit panel. The vent cover is moveable between opened and closed positions. The system may include a motor in communication with the soffit vent cover for moving the soffit vent cover between the opened and closed positions, and a primary power source and a controller in communication with the motor, and a wind speed detection device in communication with the controller. The motor may be activated to move the soffit vent cover from the opened position to the closed position upon detection of a predetermined wind speed.

17 Claims, 6 Drawing Sheets

FIG. 5A.
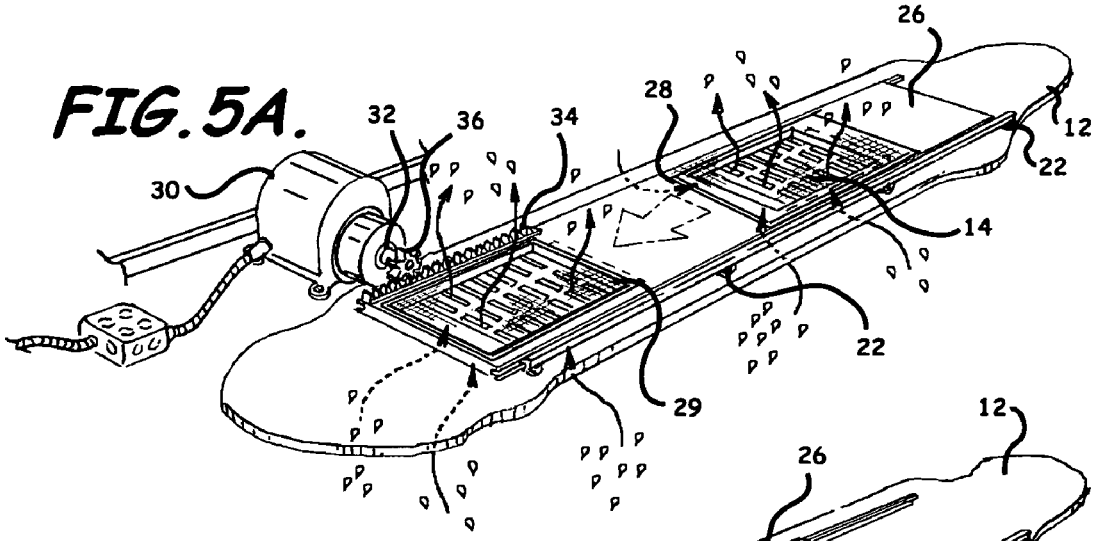
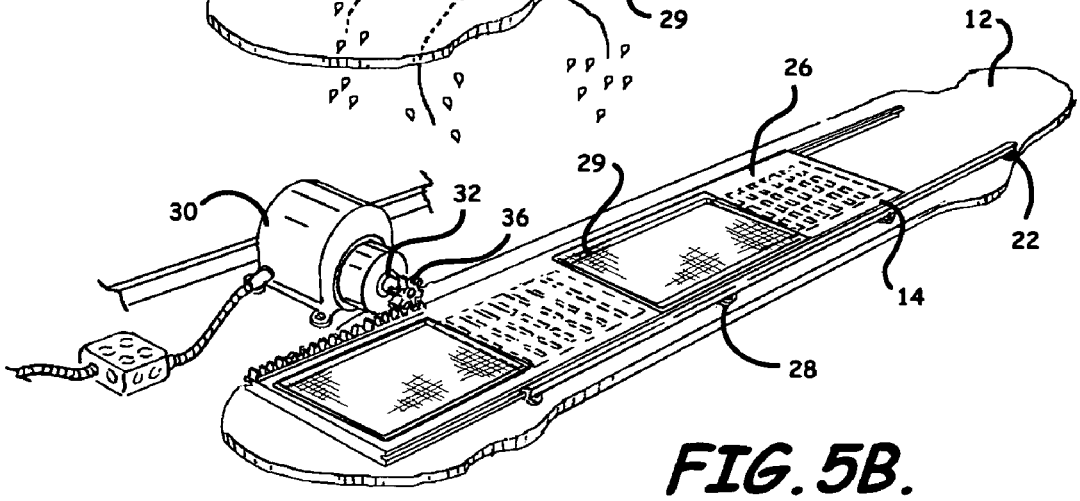
FIG. 5B.
FIG. 6.
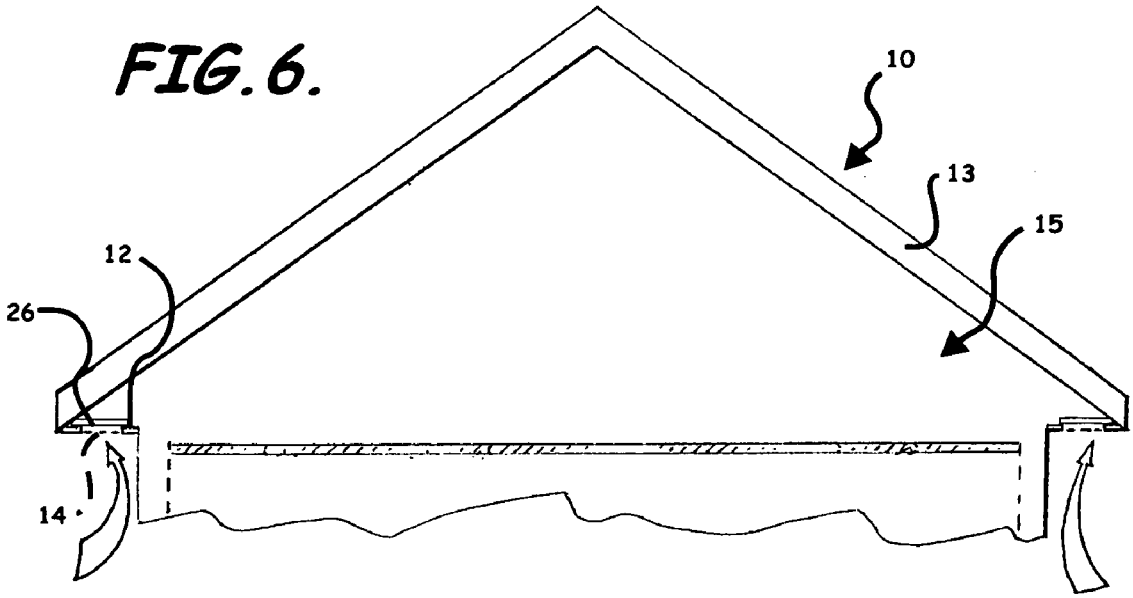

FIG. 8.
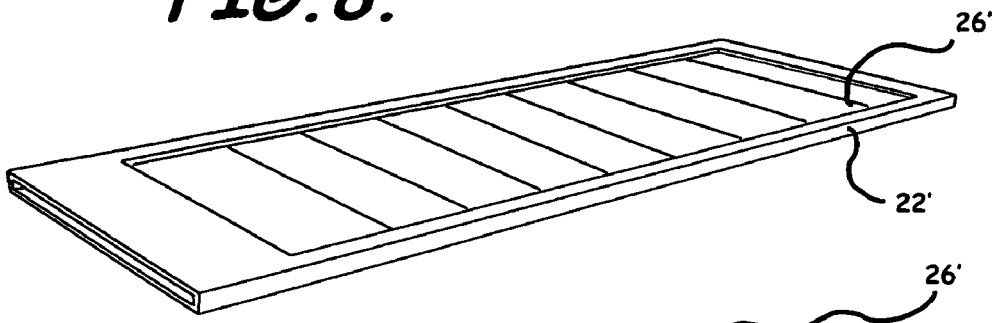
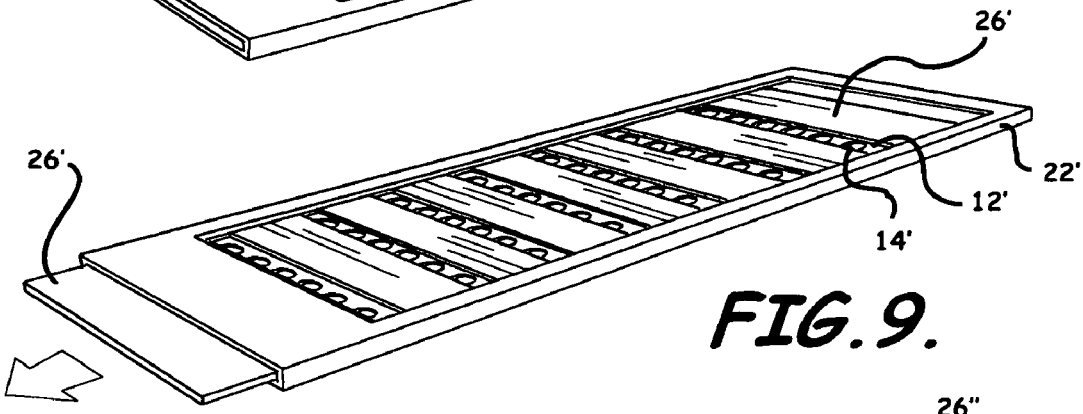
FIG. 9.
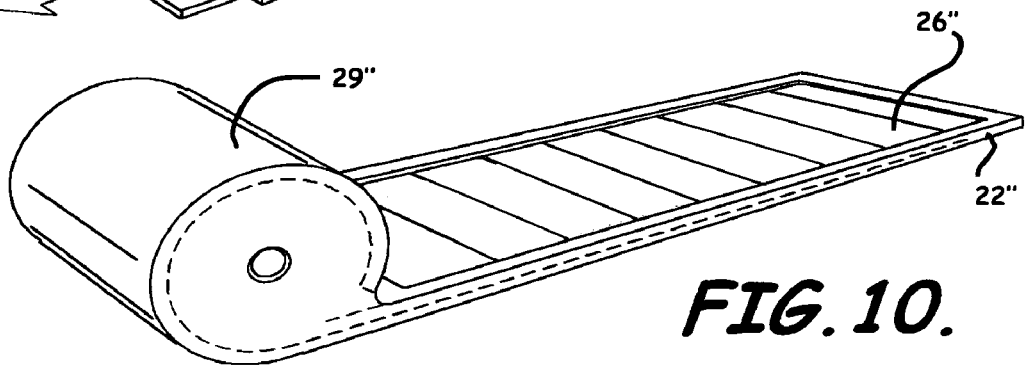
FIG. 10.
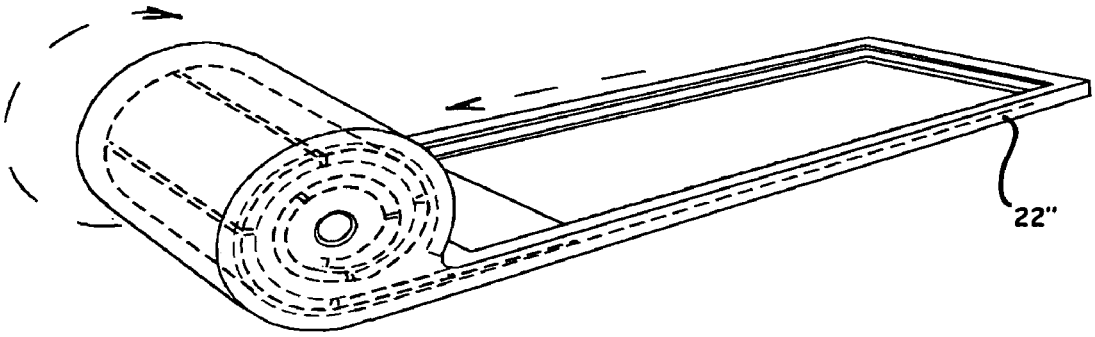
FIG. 11.

MOVEABLE SOFFIT COVER SYSTEM AND ASSOCIATED METHODS

FIELD OF THE INVENTION

The present invention relates to the field of ventilation of structures and, more particularly, to the field of soffits for structural ventilation, and related methods.

BACKGROUND OF THE INVENTION

Soffit systems are used in both residential and commercial structures to provide ventilation to attic areas. More specifically, soffit systems generally include vents that are spaced-apart along the exterior perimeter of a structure. The vents preferably release heat that tends to build up on attics, or other elevated storage areas that are not air-conditioned.

It has been observed, however, that during high wind and heavy rain conditions, such as hurricanes, for example, there may be damage to interior ceilings caused by water intrusion, and lift force caused by excessive wind speed. More specifically, it has been observed that water may intrude through the vents during hurricanes, and cause water damage to interior ceilings. Of course, an interior ceiling that has been exposed to water intrusion is likely to fail, and may even collapse into the structure.

U.S. Pat. No. 4,667,581 to Hovland discloses a soffit ventilator that may be moved between opened and closed positions responsive to a predetermined wind velocity. More specifically, the Hovland '581 patent discloses a soffit ventilator having an opening therethrough that becomes closed in response to a predetermined critical velocity of wind to thereby prevent entry of wind-driven precipitation into a building.

The system includes a damper that is hingeably attached to a housing. The damper is adapted to be maintained in a position which allows for free passage of air through the ventilator when wind is blowing below the predetermined critical velocity. The force of the wind above a predetermined critical velocity acting on the damper causes it to hinge against the opening, and remain there so long as the wind is blowing above the critical velocity.

U.S. Pat. No. 5,956,903 to Parker discloses that severe damage may be caused to structures due to pressure differentials caused by high velocity winds. More specifically, the Parker '903 patent discloses that low pressure on a downwind side of a structure may cause high internal pressures inside the structure which, in turn, may cause the roof of the structure to lift.

The use of air pressure sensing devices is disclosed to sense pressure differentials. Openings on the surface of the structure may be controlled responsive to the air pressure-sensing device so that openings on the high-pressure side of the building may be closed and openings on the low-pressure side of the building may be opened when a predetermined pressure differential is sensed. Unfortunately, however, the Parker '903 patent allows for an opening adjacent the roof which may, in turn, allow for water intrusion during such high wind conditions.

U.S. Pat. No. 2,718,187 to Frisby discloses that a house located in an area subject to sever wind storms should have ventilators which may be closed during such storms to prevent water intrusion into an attic. The ventilators include a frame having a screen positioned therein, and a plate structure connected to the frame with a spring so that the ventilator may be readily closed. The Frisby '187 patent, however, requires that the system be manually closed by the user.

SUMMARY OF THE INVENTION

In view of the foregoing background, it is therefore an object of the present invention to provide a moveable soffit cover system that may be readily installed and easily operated to prevent wind and water damage encountered during high wind conditions, such as hurricanes, for example. It is also an object of the present invention to provide a moveable soffit vent cover system that allows a soffit vent on a soffit panel to be automatically closed to thereby prevent wind and water damage to interior portions of a structure, as well as to the roof of a structure.

These and other objects, features, and advantages in accordance with the present invention are provided by a moveable soffit cover system including a guide track for connecting to a structure adjacent a soffit panel having a plurality of vents formed therein. The moveable soffit cover system may also include a soffit vent cover slidably connected to the guide track to overlie the soffit panel.

The soffit vent cover preferably has a plurality of passageways formed therein and is moveable between an opened position and a closed position. The opened position is defined by the passageways being aligned with the vents formed in the soffit panel. The closed position is defined by the passageways begin adjacent the vents so that the vents may be blocked by the soffit vent cover.

The moveable soffit cover system may also include a motor in communication with the soffit vent cover for moving the soffit vent cover between the opened and closed positions. The motor may include a rotatable shaft that rotatably engages a portion of the soffit vent cover for moving the soffit vent cover between the opened and closed positions.

The soffit vent cover may have a first end comprising a plurality of shaft engagement members. The rotatable shaft may comprise a respective plurality of vent cover engagement members. The plurality of shaft engagement members and vent cover engagement members may engage one another to move the soffit vent cover between the opened and closed positions when the rotatable shaft rotates.

The moveable soffit cover system may also include a controller in communication with the motor, and a wind speed detection device in communication with the controller. The motor may be activated to move the soffit vent cover from the opened position to the closed position upon detection of a predetermined wind speed. Accordingly, the moveable soffit cover system of the present invention advantageously allows for a soffit vent on a soffit panel to be automatically closed off, without further significant operation by a user, upon detection of a predetermined wind speed.

The motor may be activated to move the soffit vent cover from the closed position to the opened position upon sensing the wind speed below the predetermined wind speed for a predetermined amount of time. Accordingly, the moveable soffit cover system of the present invention advantageously allows for the vents of a soffit to be reopened without further significant operation by a user, upon detection of a wind speed below the predetermined wind speed for a predetermined amount of time.

The moveable soffit cover system may also include a manual soffit vent cover moving member connected to the motor and in communication with the rotatable shaft.

Accordingly, the soffit vent cover may advantageously be manually moved between the opened and closed positions by a user as desired.

The moveable soffit cover system may further include a switch in communication with the motor so that the soffit vent cover may be selectively moved between the opened and closed positions responsive to activation of said at least one switch. A primary power source may be in communication with the motor. Additionally, the moveable soffit cover system may also include a backup power source also in communication with the motor. Accordingly, backup power may advantageously be available to power the moveable soffit cover system in cases where the primary power source is unavailable.

A method aspect of the present invention is for covering a vent in a soffit panel connected to a structure. The method may include sensing a predetermined wind speed, and activating a motor to move a soffit vent cover to a closed position when a wind speed that is equal to or greater than the predetermined wind speed is detected. The method may also include activating the motor to move the soffit vent cover to an opened position when a wind speed that is lower than the predetermined wind speed is detected for a predetermined amount of time.

BRIEF DESCRIPTION OF THE DRAWINGS

FIG. 5A is a partial perspective view of a moveable soffit cover system according to the present invention and showing a soffit vent cover in an opened position.

FIG. 5B is a partial perspective view of the moveable soffit cover system according to the present invention and showing a soffit vent cover in a closed position.

FIG. 6 is a side elevation view of a structure having the moveable soffit cover system according to the present invention being installed therein and having the soffit vent cover in the closed position to prevent water and wind intrusion during high wind conditions.

FIG. 8 is a partial perspective view of another embodiment of the moveable soffit cover system according to the present invention and showing a soffit vent cover in a closed position.

FIG. 9 is a partial perspective view of the moveable soffit cover system illustrated in FIG. 8 and showing the soffit vent cover in the opened position.

FIG. 10 is a partial perspective view of another embodiment of the moveable soffit cover system according to the present invention and showing a soffit vent cover in a closed position.

FIG. 11 is a partial perspective view of the moveable soffit cover system illustrated in FIG. 10 and showing the soffit vent cover in the opened position.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations are used to describe similar elements in alternate embodiments.

Figure 1:
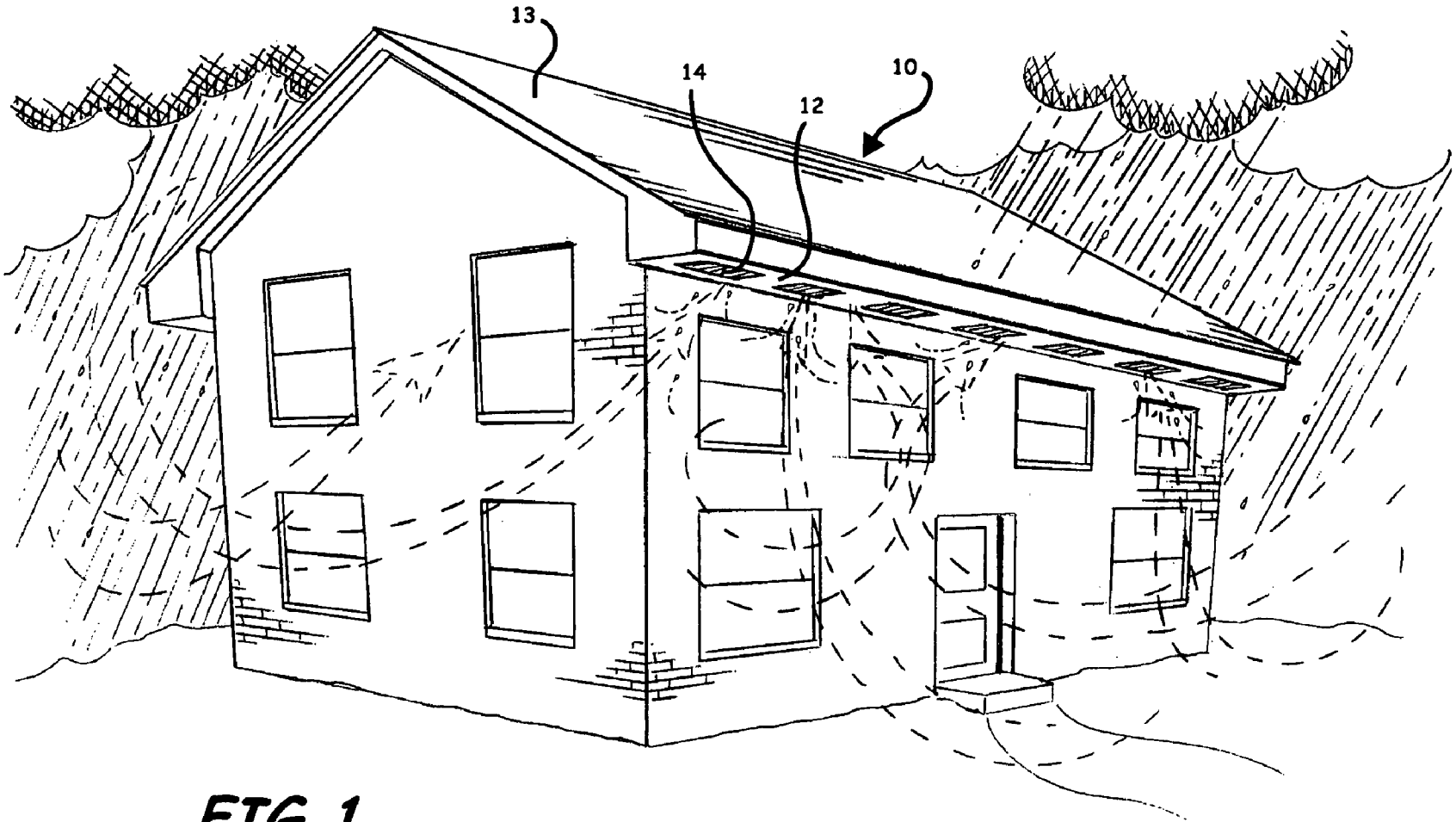
FIG. 1 is an environmental view of a structure being subjected to high wind conditions and illustrating water and wind intrusion through vents of a soffit panel.
Figure 2:
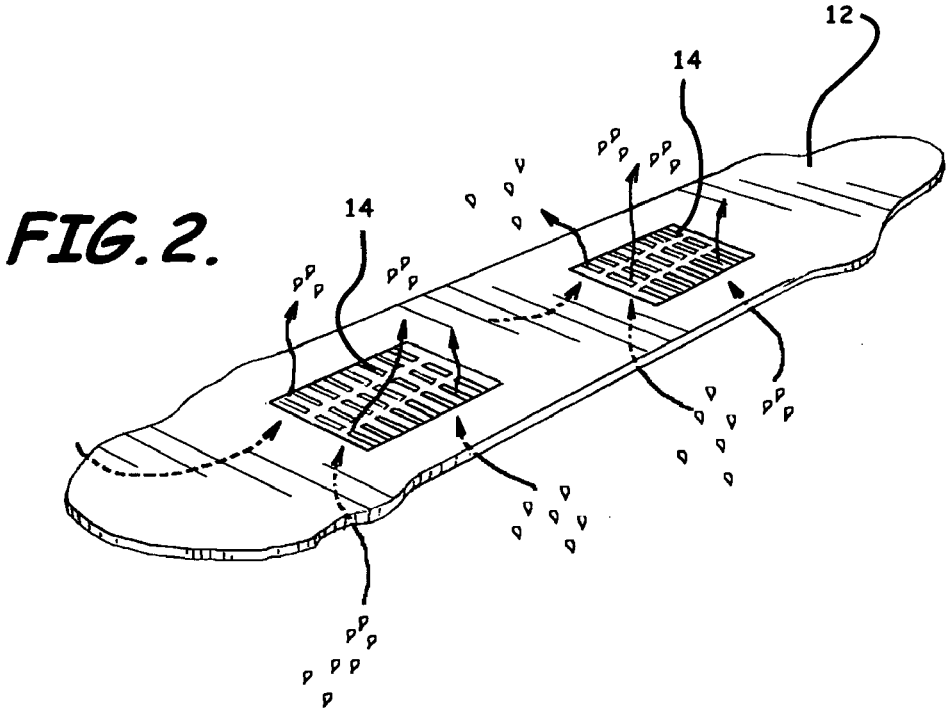
FIG. 2 is a partial perspective view of a soffit panel having a plurality of spaced apart vents and showing water and wind intrusion during high wind conditions.
Figure 3:
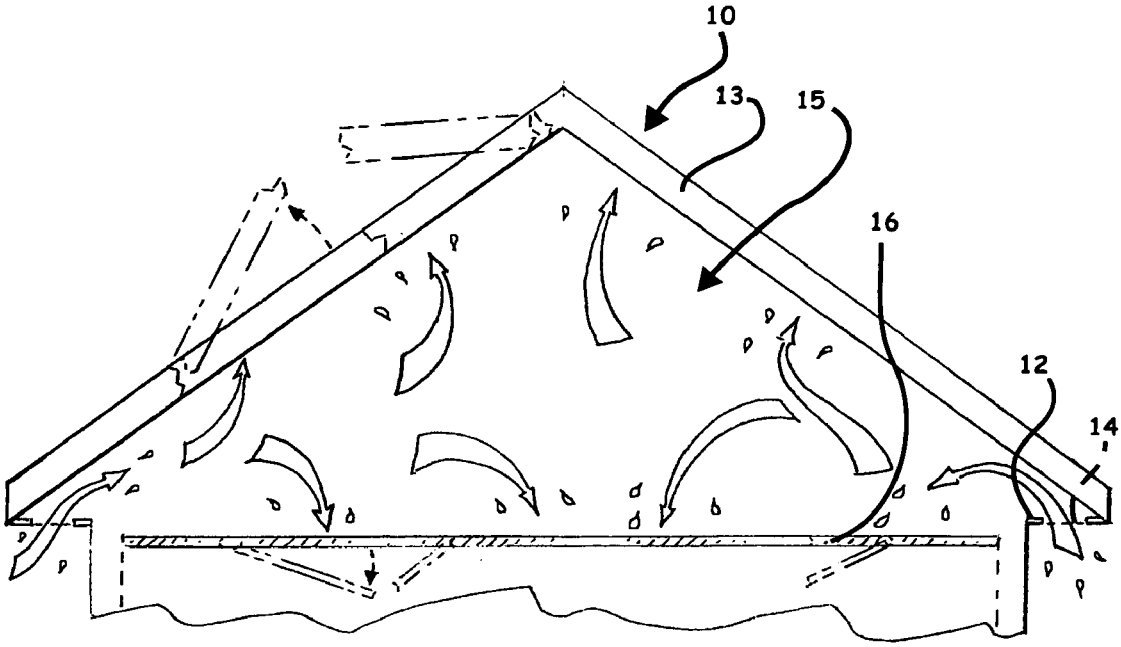
FIG. 3 is a front elevation view of a structure being damaged by water and wind intrusion through vents of a soffit panel.
Figure 4:
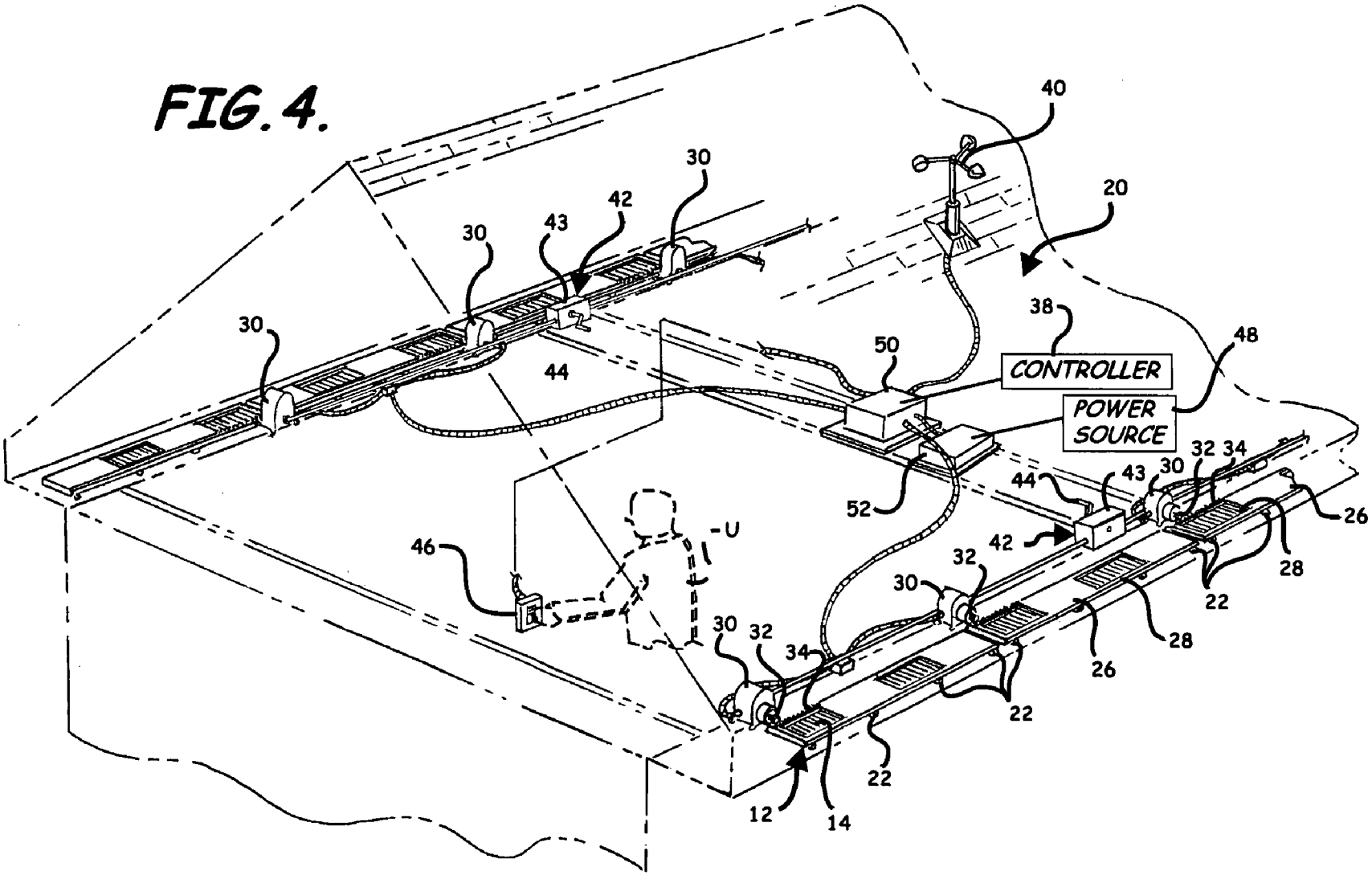
FIG. 4 is a partial perspective view and schematic diagram of a moveable soffit cover system according to the present invention.
Figure 7:
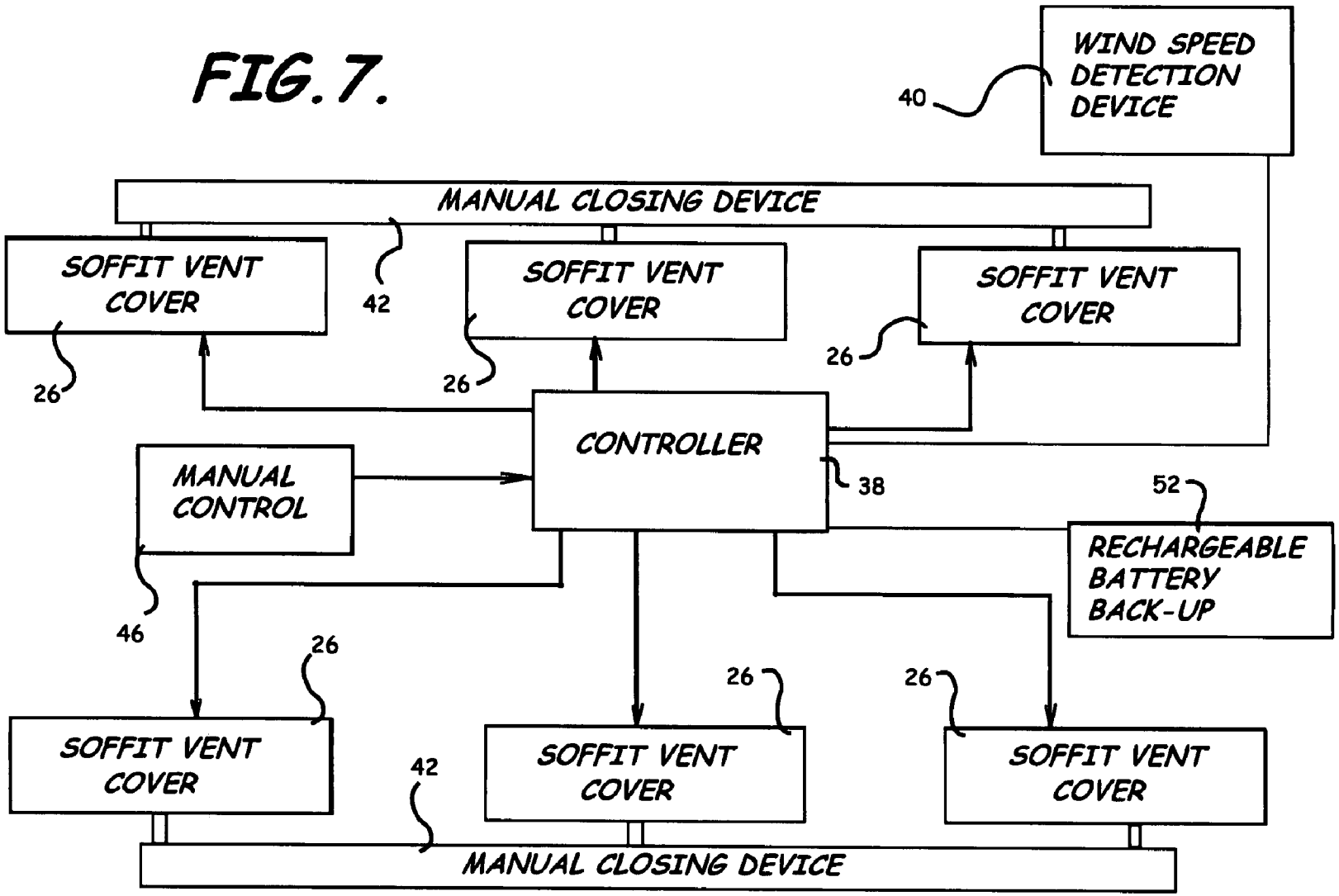
FIG. 7 is a schematic diagram of the moveable soffit cover system according to the present invention.

Referring initially to FIGS. 1–3, a structure 10 may illustratively include a soffit panel 12 positioned adjacent an eve of a roof 13. The soffit panel 12 illustratively includes a plurality of vents 14. The soffit panel 12 is generally an elongate soffit panel, and the vents 14 are preferably rectangular and spaced-apart along the soffit panel.

The vents 14 advantageously provide ventilation to an attic area 15 of a structure 10. More specifically, an attic area 15 of a structure 10 tends to build up excessive heat. The vents 14 in the soffit panel 12 advantageously provide ventilation to decrease the heat build up in the attic area 15.

As perhaps best illustrated in FIGS. 2 and 3, however, during high wind conditions, such as hurricanes, for example, water and wind may intrude through the vents 14 of the soffit panel 12 and into the attic area 15 of the structure 10. This intrusion of water and wind may cause damage to the interior ceiling structure 16, as well as possible damage to the roof 13. More specifically, accumulation of moisture caused by the water intrusion may cause the interior ceiling structure 16 to fail. Further, excessive wind intrusion through the vents 14 of the soffit panel 12 may cause a lift condition, resulting in damage to the roof 13 of the structure 10.

Referring now initially to FIGS. 4–7, a moveable soffit cover system 20 in accordance with the present invention to prevent such wind and water intrusion during high wind conditions is now described in detail. The moveable soffit cover system 20 illustratively includes a plurality of guide tracks 22 connected to the structure 10. More specifically, the guide tracks 22 are preferably connected to the structure 10 adjacent the vents 14 of the soffit panel 12.

The guide tracks 22 may illustratively be provided by a plurality of spaced-apart guide members. Those skilled in the art, however, will appreciate that the guide tracks 22 may also be provided by any other type of track suitable for mounting to the structure 10 adjacent the soffit panel 12 for use with the moveable soffit cover system 20 of the present invention.

The moveable soffit cover system 20 also illustratively includes a plurality of soffit vent covers 26 slidably connected to the guide tracks 22 to overlie the soffit panels 12. More specifically, the plurality of soffit vent covers 26 may illustratively have passageways 28 formed therein. The soffit vent covers 26 are preferably elongate soffit vent covers and the passageways 28 preferably have a polygonal shape. Those skilled in the art will appreciate that the passageways 28 may have any shape, but it is preferable that the shape and size be substantially similar to the vents 14 in the soffit panels 12 to advantageously provide maximum ventilation to the attic area 15 of the structure 10.

The soffit vent covers 26 are preferably moveable between opened and closed positions. The opened position (illustrated in FIG. 5A) is preferably defined by the passageways 28 in the soffit vent covers 26 being aligned with respective vents 14 in the soffit panels 12. The closed position (illustrated in FIG. 5B) is preferably defined by the passageways 28 in the soffit vent covers 26 being adjacent the vents 14 in the soffit panel 12 so that the vents in the soffit panel are blocked by the soffit vent covers.

Accordingly, the vents 14 of the soffit panel 12 may be selectively blocked when the soffit vent cover 26 is in the closed position. This advantageously prevents high wind and water intrusion into the attic area 15 of a structure 10, thereby preventing damage to an interior ceiling structure 16 and the roof 13 of the structure.

The moveable soffit cover system 20 of the present invention may also illustratively include a screen member 19 positioned adjacent the vents 14 of the soffit panel 12. The screen member 19 advantageously prevents entry of insects, rodents, and vermin in general through the vents of the soffit panel 12 when the soffit vent cover 26 is in the opened position.

The moveable soffit cover system 20 also illustratively includes a plurality of motors 30 in communication with the plurality of soffit vent covers 26. The motors 30 move the soffit vent cover 26 between the opened and closed positions. Further, each of the motors 30 preferably includes a rotatable shaft 32 that rotatably engages a portion of the soffit vent cover 26 for moving the soffit vent cover between the opened and closed positions. Although a plurality of motors 30 are illustrated in the appended drawings, those skilled in the art will appreciate that the plurality of soffit vent covers 26 may be in communication with one motor for effecting movement of the soffit vent covers between the opened and closed positions.

Each soffit vent cover 26 may have a first end comprising a plurality of shaft engagement members 34. Further, the rotatable shaft 32 of the motor 30 illustratively includes a respective plurality of vent cover engagement members 36. The plurality of shaft engagement members 34 and vent cover engagement members 36 illustratively engage one another to move the vent cover 26 between the opened position, as illustrated in FIG. 5A, and the closed position, as illustrated in FIG. 5B. As perhaps best illustrated in FIG. 6, when the soffit vent cover 26 is in the closed position, water and wind intrusion during high wind conditions may advantageously be prevented.

The moveable soffit cover system 20 also illustratively includes a controller 38 in communication with each of the motors 30. The controller 38 may illustratively be carried by a housing 50. The moveable soffit cover system 20 may also illustratively include a wind speed detection device 40 in communication with the controller 38. The wind speed detection device 40 is preferably connected to the roof 13 of the structure 10, but those skilled in the art will appreciate that the wind speed detection device may be connected to the structure adjacent any exterior portion suitable for measuring wind speed adjacent the structure.

The motors 30 may be activated to move the soffit vent cover 26 from the opened position to the closed position upon detection of a predetermined wind speed. For example, the predetermined wind speed may be 50 miles per hour so that the soffit vent covers 26 may be moved to the closed position in the event of high wind speed conditions, such as a hurricane, for example. This advantageously provides for closure of the vents 14 in the soffit panels 12 without significant involvement of a user U.

The motors 30 may also be activated to move the soffit vent covers 26 from the closed position back to the opened position upon sensing the wind speed below the predetermined wind speed for a predetermined amount of time. For example, after the soffit vent covers 26 have been moved to the closed position due to detection of a wind speed higher than the predetermined wind speed, if wind speed is detected below the predetermined wind speed for a predetermined amount of time, e.g., below 50 miles per hour for greater than 5 minutes, the soffit vent cover may thereafter be moved to the opened position to resume ventilation of the attic area 15 of the structure 10. Again, this advantageously allows the soffit vent cover 26 to be moved without significant involvement of the user U.

The moveable soffit cover system 20 of the present invention also illustratively includes a manual soffit vent cover moving member 42 connected to the motors 30 and in communication with the rotatable shaft 32 of the motors so that the soffit vent covers 26 may be selectively, manually moved between the opened and closed positions. More particularly, the manual soffit vent cover moving member 42 may include a housing 43 positioned adjacent the motors 30, and a crank 44 that may be engaged by a user U. Movement of the crank 44 preferably causes rotation of the rotatable shafts 32 of each motor 30 to thereby cause movement of the soffit vent covers 26 between the opened and closed positions.

The moveable soffit cover system 20 also illustratively includes a switch 46 in communication with the motors 30 so that the soffit vent covers 26 may be selectively moved between the opened and closed positions responsive to activation of the switch. More specifically, the switch 46 is preferably connected to the controller 38 to cause activation and deactivation of the motors 30. Those skilled in the art will appreciate that any type of switch suitable for causing activation and deactivation of the motors 30 is contemplated by the present invention.

The moveable soffit cover system 20 also illustratively includes a primary power source 48 carried by the housing 50 and connected to each motor 30. The primary power source 48 may, for example, be provided through the main power system to the structure 10. The primary power source 48 may also be a battery, or any other type of power source, as understood by those skilled in the art. The moveable soffit cover system 20 of the present invention also preferably includes a backup power source 52 positioned in communication with each of the motors 30.

The backup power source 52 advantageously provides power to the moveable soffit cover system 20 in the event that the primary power source 48 fails. As discussed in greater detail above, however, in the event of failure of the backup power source 52, the user U may move the soffit vent covers 26 between the opened and closed positions using the manual soffit vent cover moving member 42.

Referring now additionally to FIGS. 8 and 9, another embodiment of the moveable soffit cover system 20' according to the present invention is now described in greater detail. More specifically, the moveable soffit cover system 20' includes a soffit vent cover 26' that slidably engages a guide track 22'. The soffit vent cover 26' is a nesting soffit vent cover. Accordingly, when in the opened position (illustrated in FIG. 9), portions of the soffit vent cover 26' are nested within other portions of the soffit vent cover so that the vents 14' in the soffit panel 12' are exposed. The other elements of this embodiment of the moveable soffit cover system 20' are similar to those of the first embodiment of the moveable soffit cover system 20, are labeled with prime notation, and require no further discussion herein.

Referring now additionally to FIGS. 10 and 11, still another embodiment of the moveable soffit cover system 20"

according to the present invention is now described in greater detail. More specifically, the moveable soffit cover system 20" includes a rolled soffit vent cover 26" that slidably engages a guide track 22". The rolled soffit vent cover 26" may be stored in a soffit vent cover storage member 29" adjacent the guide track 22". Accordingly, when in the opened position (illustrated in FIG. 11), the rolled soffit vent cover 26" may be stored within the soffit vent cover storage member 29" and the vents 14" of the soffit panel 12" may be exposed. When it is desired to move the soffit vent cover 26" to the closed position, the soffit vent cover may be unrolled from within the soffit vent cover storage member 29" to cover the vents 14" in the soffit panel 12". The other elements of this embodiment of the moveable soffit cover system 20" are similar to those of the first embodiment of the moveable soffit cover system 20, are labeled with double-prime notation, and require no further discussion herein.

A method aspect of the present invention is for covering a vent 14 in a soffit panel 12 connected to a structure 10. The method preferably comprises sensing a predetermined wind speed using the wind speed detection device 40. The method also preferably includes activating the motors 30 to move the soffit vent covers 26 to the closed position when a wind speed that is equal to or greater than the predetermined wind speed is detected. The method further comprises activating the motors 30 to move the soffit vent covers 26 to an opened position when a wind speed that is lower than the predetermined wind speed is detected for a predetermined amount of time.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A moveable soffit cover system comprising:

at least one guide track for connecting to a structure adjacent a soffit panel having a plurality of vents formed therein;

at least one soffit vent cover slidably connected to said at least one guide track to overlie the soffit panel, said at least one soffit vent cover having a plurality of passageways formed therein and being moveable between an opened position and a closed position, the opened position being defined by the passageways being aligned with the vents formed in the soffit panel, and the closed position being defined by the passageways being adjacent the vents so that the vents are blocked by said at least one soffit vent cover; and a motor in communication with said at least one soffit vent cover for moving said at least one soffit vent cover between the opened and closed positions, said motor comprising a rotatable shaft that rotatably engages a portion of said at least one soffit vent cover for moving said at least one soffit vent cover between the opened and closed positions;

wherein said at least one soffit vent cover has a first end comprising a plurality of shaft engagement members;

wherein the rotatable shaft comprises a respective plurality of vent cover engagement members; and wherein the plurality of shaft engagement members and vent cover engagement members engage one another to move said at least one soffit vent cover between the opened and closed positions when the rotatable shaft rotates.

2. A moveable soffit cover system according to claim 1 further comprising a controller in communication with said motor, and a wind speed detection device in communication with the controller; and wherein said motor is activated to move said at least one soffit vent cover from the opened position to the closed position upon detection of a predetermined wind speed.

3. A moveable soffit cover system according to claim 2 wherein said motor is activated to move said at least one soffit vent cover from the closed position to the opened position upon sensing the wind speed below the predetermined wind speed for a predetermined amount of time.

4. A moveable soffit cover system according to claim 1 further comprising a manual soffit vent cover moving member connected to said motor and in communication with the rotatable shaft so that said at least one soffit vent cover may be selectively, manually moved between the opened and closed positions.

5. A moveable soffit cover system according to claim 1 further comprising at least one switch in communication with said motor so that said at least one soffit vent cover may be selectively moved between the opened and closed positions responsive to activation of said at least one switch.

6. A moveable soffit cover system according to claim 1 further comprising a primary power source in communication with said motor, and a backup power source in communication with said motor.

7. A moveable soffit cover system comprising:

at least one guide track for connecting to a structure adjacent a soffit panel having a plurality of vents formed therein;

at least one soffit vent cover slidably connected to said at least one guide track to overlie the soffit panel, said at least one soffit vent cover being moveable between opened and closed positions;

a motor in communication with said at least one soffit vent cover for moving said at least one soffit vent cover between the opened and closed positions;

a primary power source in communication with said motor;

a controller in communication with said motor; and a wind speed detection device in communication with said controller;

said motor being activated to move said soffit vent cover from the opened position to the closed position upon detection of a predetermined wind speed; and wherein said at least one soffit vent cover has a plurality of passageways formed therein; and wherein the opened position is defined by the passageways being aligned with the vents formed in the soffit panel, and the closed position is defined by the passageways being adjacent the vents so that the vents are blocked by said at least one soffit vent cover.

8. A moveable soffit cover system according to claim 7 wherein said motor is activated to move said at least one soffit vent cover from the closed position to the opened position upon sensing the wind speed below the predetermined wind speed for a predetermined amount of time.

9. A moveable soffit cover system according to claim 7 wherein said motor comprises a rotatable shaft that rotatably engages a portion of said at least one soffit vent cover for moving said at least one soffit vent cover between the opened and closed positions.

10. A moveable soffit cover system according to claim 9 wherein said at least one soffit vent cover has a first end comprising a plurality of shaft engagement members; wherein the rotatable shaft comprises a respective plurality of vent cover engagement members; and wherein the plurality of shaft engagement members and vent cover engagement members engage one another to move said at least one soffit vent cover between the opened and closed positions when the rotatable shaft rotates.

11. A moveable soffit cover system according to claim 9 further comprising a manual soffit vent cover moving member connected to said motor and in communication with the rotatable shaft so that said at least one soffit vent cover may be selectively, manually moved between the opened and closed positions.

12. A moveable soffit cover system according to claim 7 further comprising at least one switch in communication with said motor so that said at least one soffit vent cover may be selectively moved between the opened and closed positions responsive to activation of said at least one switch.

13. A method for covering a vent in a soffit panel connected to a structure, the method comprising:

sensing a predetermined wind speed;

activating a motor to move a soffit vent cover to a closed position when a wind speed that is equal to or greater than the predetermined wind speed is detected; and activating the motor to move the soffit vent cover to an opened position when a wind speed that is lower than the predetermined wind speed is detected for a predetermined amount of time; and wherein the soffit vent cover has a plurality of passageways formed therein; and wherein the opened position is defined by the passageways being aligned with the vents formed in the soffit panel, and the closed position is defined by the passageways being adjacent the vents so that the vents are blocked by said at least one soffit vent cover.

14. A method according to claim 13 wherein the motor is in communication with a primary power source and a backup power source.

15. A method according to claim 13 wherein the soffit vent cover is moved between the opened and closed positions by rotatably engaging vent cover engagement members on a rotatable shaft of the motor with shaft engagement members on the soffit vent cover.

16. A method according to claim 13 wherein the soffit vent cover is moved between the opened and closed positions by selectively, manually moving the soffit vent cover using a manual soffit vent cover moving member connected to the motor.

17. A method according to claim 13 further comprising engaging a switch in communication with the motor to selectively move the soffit vent cover between the opened and closed positions.

* * * * *